US010106993B2

(12) United States Patent
Harrison

(10) Patent No.: US 10,106,993 B2
(45) Date of Patent: Oct. 23, 2018

(54) CURB, WALK, AND MULTI-USE FORMING TOOL AND SYSTEM

(71) Applicant: William Clifton Harrison, Billings, MT (US)

(72) Inventor: William Clifton Harrison, Billings, MT (US)

( * ) Notice: Subject to any disclaimer, the term of this patent is extended or adjusted under 35 U.S.C. 154(b) by 0 days.

(21) Appl. No.: 15/731,241

(22) Filed: May 8, 2017

(65) Prior Publication Data

US 2018/0073205 A1 Mar. 15, 2018

Related U.S. Application Data

(60) Provisional application No. 62/391,826, filed on May 11, 2016.

(51) Int. Cl.
*E04G 17/12* (2006.01)
*E01C 19/50* (2006.01)
*B28B 1/14* (2006.01)

(52) U.S. Cl.
CPC ..... *E04G 17/12* (2013.01); *E01C 19/506* (2013.01); *B28B 1/14* (2013.01)

(58) Field of Classification Search
CPC ..... E04G 13/04; E04G 17/12; E04C 19/50; E04C 19/502; E04C 19/504; E04C 19/506; E04C 19/508
USPC ..... 249/2, 3, 4, 5, 6, 7, 8, 34, 208, 216
See application file for complete search history.

(56) References Cited

U.S. PATENT DOCUMENTS 657,802 A * 9/1900 Watson ..... E01C 19/506 249/157
765,360 A * 7/1904 Hanlon ..... E01C 19/506 249/208
1,109,433 A * 9/1914 Leydecker et al. ... E01C 19/506 249/5
1,279,059 A * 9/1918 Whiteway et al. ... E01C 19/506 249/157
1,770,518 A * 7/1930 Harrold ..... E01C 19/506 249/157
2,234,335 A * 3/1941 Echterling ..... E04G 17/18 249/211
2,400,852 A * 5/1946 Stevenson ..... E04G 17/12 249/194

(Continued)

*Primary Examiner* — Michael Safavi

(57) ABSTRACT

A curb/walk forming bracket has two half brackets connected to form a spacer/bracket. Each half bracket has a main body with an outer fin and an inner fin for attachment to form boards. A top bend extends from the main body and has a guide hole for placement of a stake. A lower guide hole or formed surround extends from the main body and is vertically aligned with the top guide hole. Slots or slotted holes run the length of the top bend of the main body of each half bracket with the slots or slotted holes accommodating fasteners for connecting the two half brackets so as to form an inverted "U" shape when placed for forming in an upright position. Holes are provided in the main body of each half bracket for fastening stakes for ground anchorage. Holes along each inner fin of each half bracket allow fastening to the form boards. The curb/walk forming bracket can be adjusted to different widths with variable widths achieved by overlapping the half components, moving them back and forth and fastening at the desired width.

1 Claim, 9 Drawing Sheets

(56) References Cited

U.S. PATENT DOCUMENTS

| | | | | | |
|---|---|---|---|---|---|
| 2,449,725 | A * | 9/1948 | Slater | E04G 17/12 | 249/22 |
| 2,549,758 | A * | 4/1951 | Cotner | E04G 17/12 | 249/192 |
| 2,610,660 | A * | 9/1952 | Jennings | E04G 17/12 | 249/219.2 |
| 2,711,573 | A * | 6/1955 | Bliss | B28B 7/0014 | 249/210 |
| 4,029,288 | A * | 6/1977 | Murphy | E04G 13/00 | 249/216 |
| 5,156,753 | A * | 10/1992 | Speidel | B28B 7/02 | 249/159 |
| 6,390,440 | B1 * | 5/2002 | Morin | E04G 13/00 | 249/219.1 |
| 7,182,309 | B1 * | 2/2007 | Olsen | E01C 19/506 | 249/2 |
| 7,255,319 | B2 * | 8/2007 | Albano | E04G 13/00 | 249/34 |

* cited by examiner

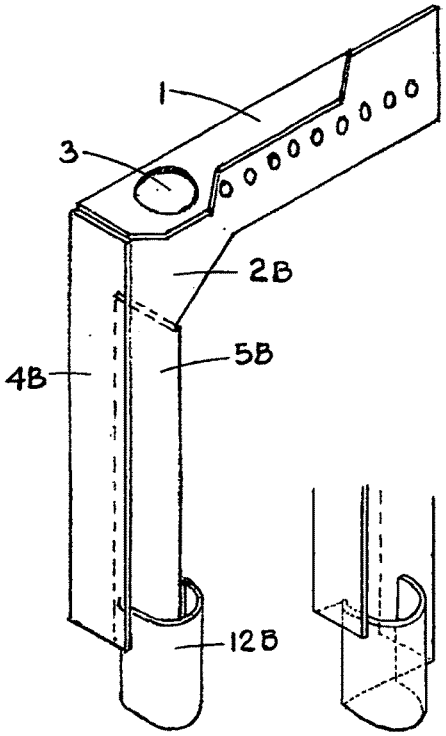
FIG 7
FIG 7D
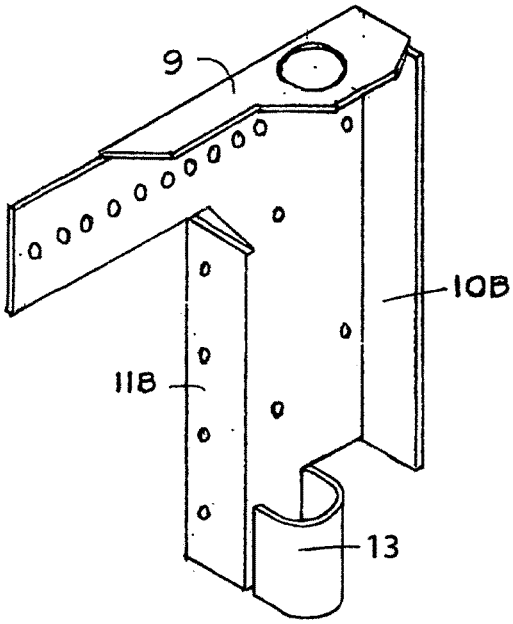
FIG 8
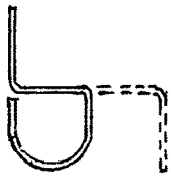
FIG 8A
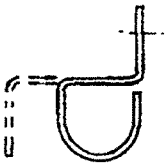
FIG 7A
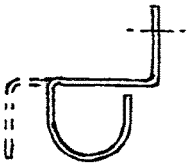
FIG 7E
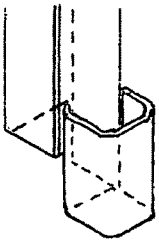
FIG 7B
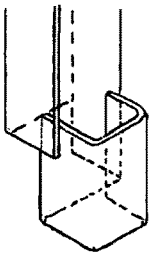
FIG 7F
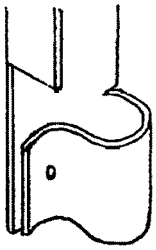
FIG 7H
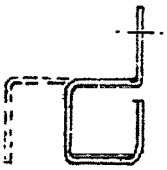
FIG 7C
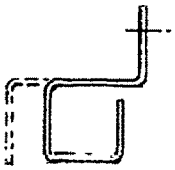
FIG 7G
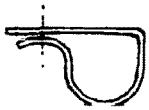
FIG 7I
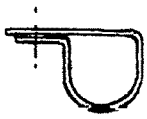
FIG 7J

CURB, WALK, AND MULTI-USE FORMING TOOL AND SYSTEM

CROSS-REFERENCE TO RELATED APPLICATIONS

RE: PPA No. 62/391,826 file May 11, 2016

STATEMENT REGARDING FEDERALLY SPONSORED RESEARCH OR DEVELOPMENT

Not applicable

THE NAMES OF THE PARTIES TO A JOINT RESEARCH AGREEMENT

None

STATEMENT REGARDING PRIOR DISCLOSURES BY THE INVENTOR OR JOINT INVENTOR

None

BACKGROUND OF THE INVENTION

My background in working with and teaching inexperienced workers in forming and pouring very complex odd and angular concrete foundations often had me thinking of ways to make the work easier for do-it-yourselfers.

This was the genesis for the developing of this tool. My own experience with tools, forming and pouring concrete began at age 10 working for my contractor father, polishing set, but green concrete.

SUMMARY

The tool, used in multiples together with other materials such as off the shelf boards and ground anchors, is used to develop a system of forming and pouring areas of plasticized materials such as, but not limited to plain, colored, decorative concrete, terrazo, and other composits.

The tool is designed to serve as a guide and anchor for formboards and to facilitate the accurate forming and pouring of, but not limited to, the following:

1. Freestanding curbs—straight, multi-curved, arced
2. Walks—straight, multi-curved, arced
3. Edging and curbs on existing walks
4. Borders on existing and new terraces and patios
5. Decorative divider strips and patterns in new terraces and patios
6. Drainage troughs
7. Raised garden planters, borders, and yard area dividers
8. Foundation grade beams for construction support
9. Foundation stem walls for construction support
10. Pads for different uses, including, but not limited to, pads for utilities and air conditioning units

BRIEF DESCRIPTION OF THE SEVERAL VIEWS OF THE DRAWINGS

FIGS. 7, 7B, 7D, 7F, 7H and 8 show different embodiments for the brackets, wherein options for the lower housing and guide for ground anchors are shown and modification of the corresponding main body and fins is as required.

FIGS. 7A, 7C, 7E, 7G, 7I, 7J and 8A show footprints of embodiments FIGS. 7, 7B, 7D, 7F, 7H, and 8 respectively. Where fins or the main body of the bracket are foreshortened, FIGS. 7A, 7C, 7E, 7G, and 8A are shown as double dotted lines.

DETAILED DESCRIPTION OF DRAWINGS AND SPECIFICATIONS

Figure 1:
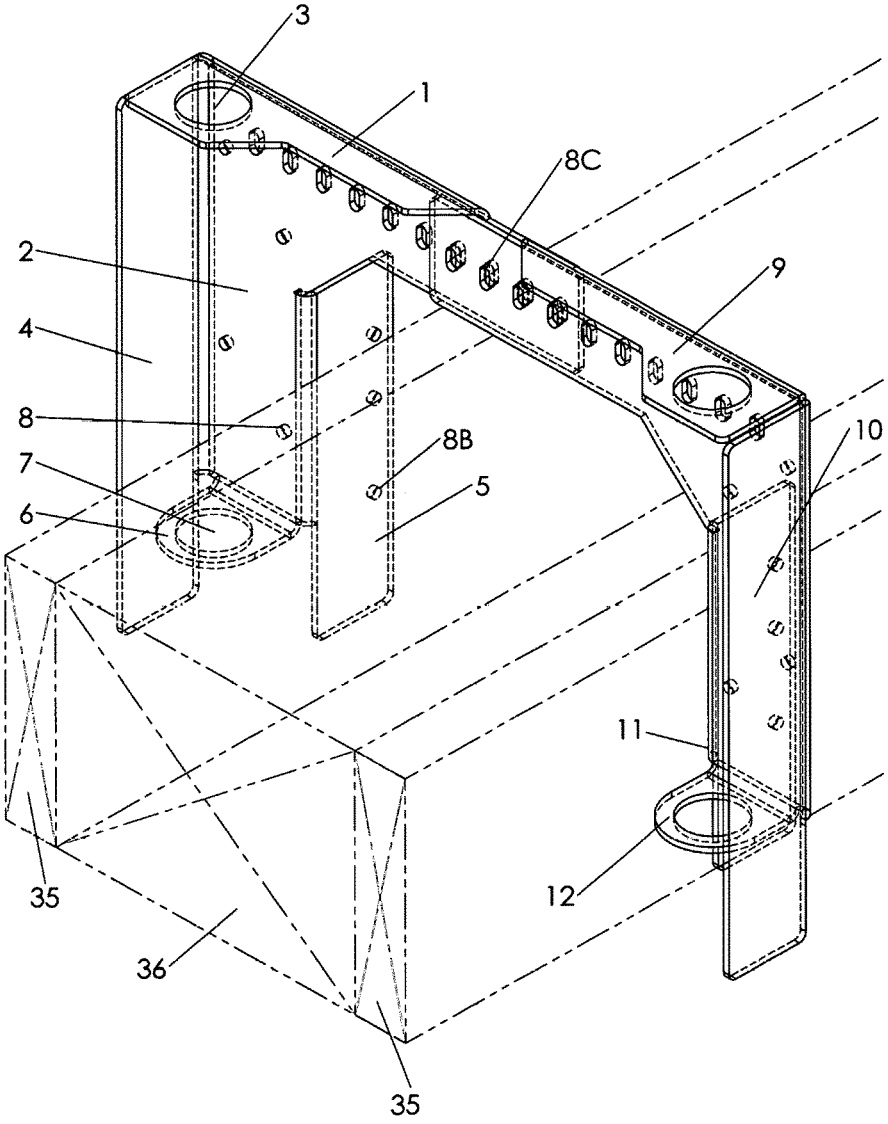
FIGS. 1, 1A, 1B, and 2 are perspective views of the brackets and their components. The brackets have multiple uses, one of which is to assist, along with other materials such as formboards and ground anchors, in forming and pouring plasticized material.

For a "CURB, WALK AND MULTI-USE FORMING TOOL AND SYSTEM" The tool consists of a bracket, spacer, their components and fasteners. The bracket, FIGS. 1 and 2 is designed to anchor and contain the formboards that establish the limits of the poured material. The bracket is adjustable in width. That is one of the reasons that it is made up of two similar or identical halves, FIGS. 1, 1A, 1B and 2. Each half is designed to anchor a formboard or forming material.

In forming a bracket, the halves overlap each other. By sliding them back and forth, the user can set the desired width and interlock them to form a bracket, using screws or other fasteners.

Figure 4:
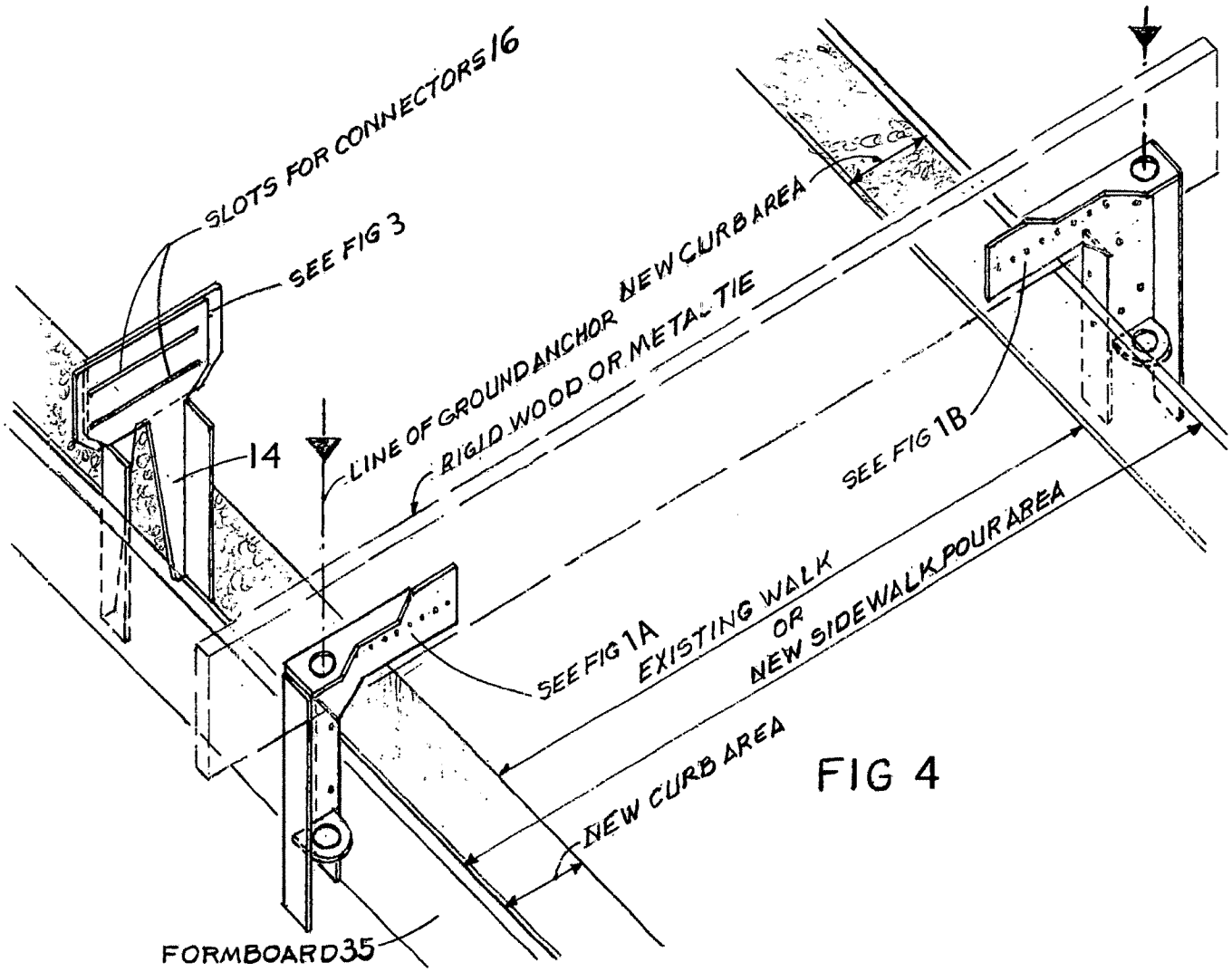
FIG. 4 is a perspective view, using the bracket components and spacers for forming a sidewalk pour or a curbed edging to existing sidewalks or to other existing pours that are not shown.

The bracket, in an upright position, appears somewhat like an inverted "U" shape that can straddle the pour area and the formboards and attach thereto. Ground anchorage of the bracket is achieved by metal stakes, re-bar, or spikes that thread through vertically aligned guide holes or enclosures that are a part of the bracket and are described as follows:

Each bracket half has a minimum of two guides for the metal anchors. The horizontal part of the top contains a round hole for the anchor to thread through. The vertical part has a guide hole, or formed surround that is aligned vertically with the top hole to provide a straight and clear vertical path for the round metal anchor which is to be driven into the ground. Ground anchorage can also be accomplished with wood or similar stakes that are fastened to the main body and/or fins of the bracket by the use of screws, nails or similar attachments.

Where it is desired to form edging or curbs to existing pours such as walkways, patios, etc. or to form pours for new sidewalks FIG. 4, drain troughs, pads or pours that are wider than the bracket can straddle, bracket halves can be connected by rigid ties.

Figure 3:
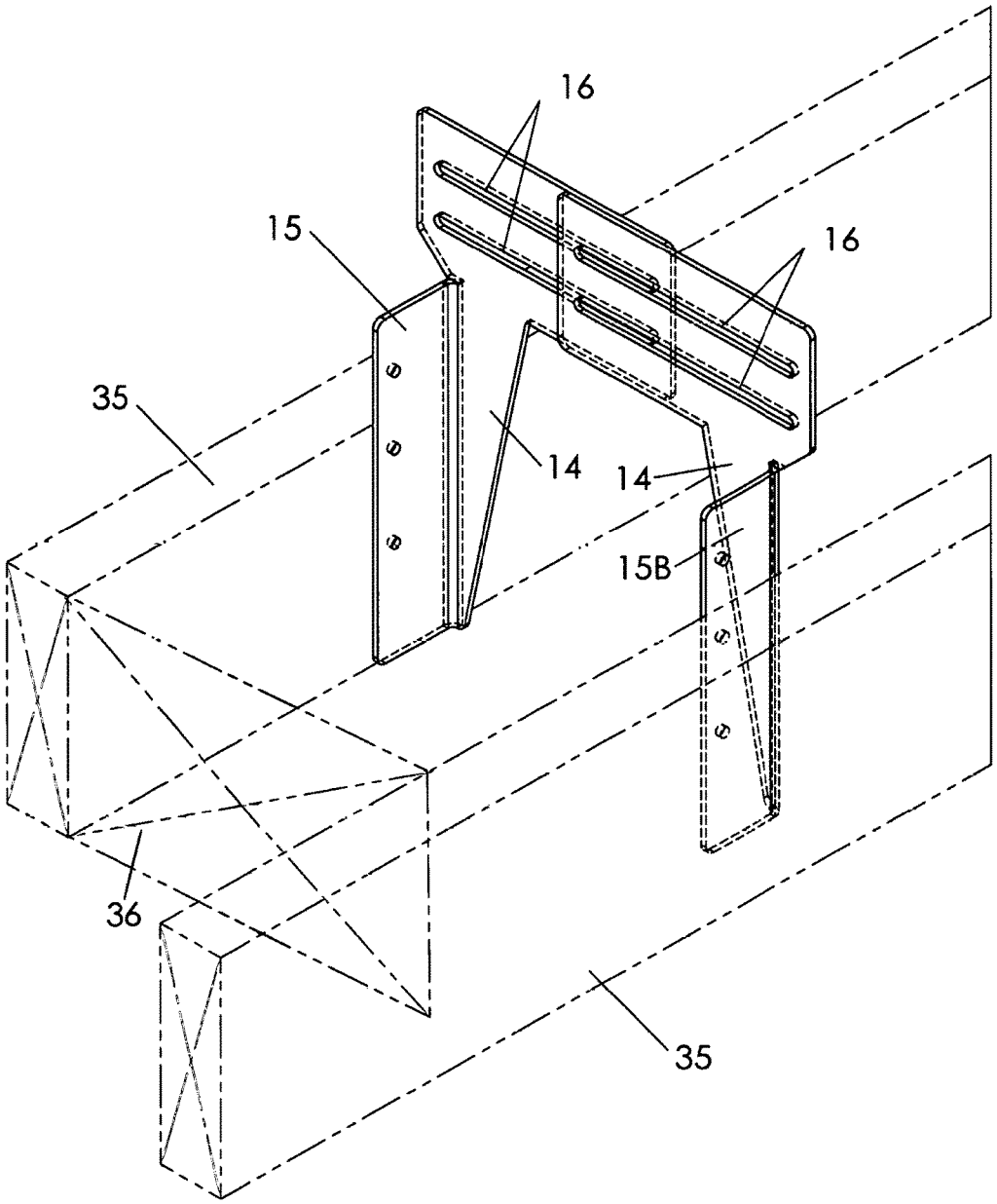
FIGS. 3, 3A, and 3B are perspective views of the spacer and its components that is used to maintain the integrity of the pour area.
Figure 3A:
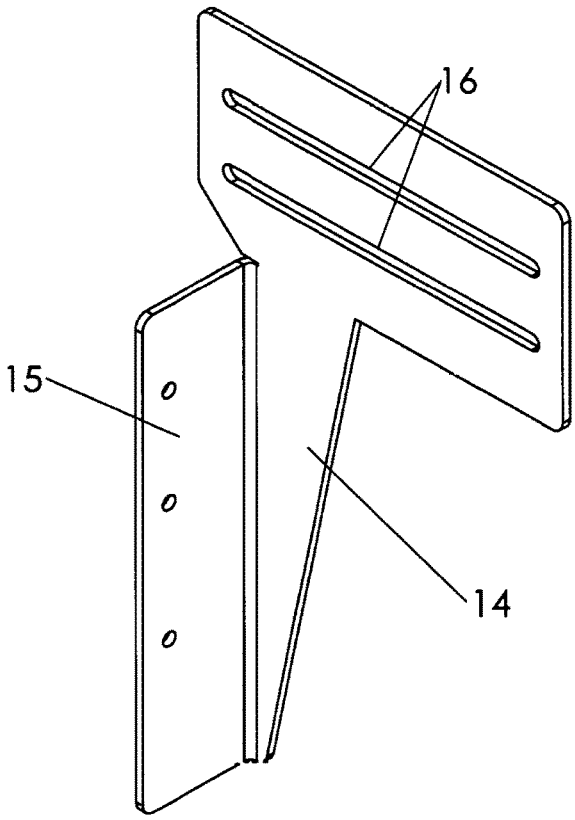
Figure 3B:
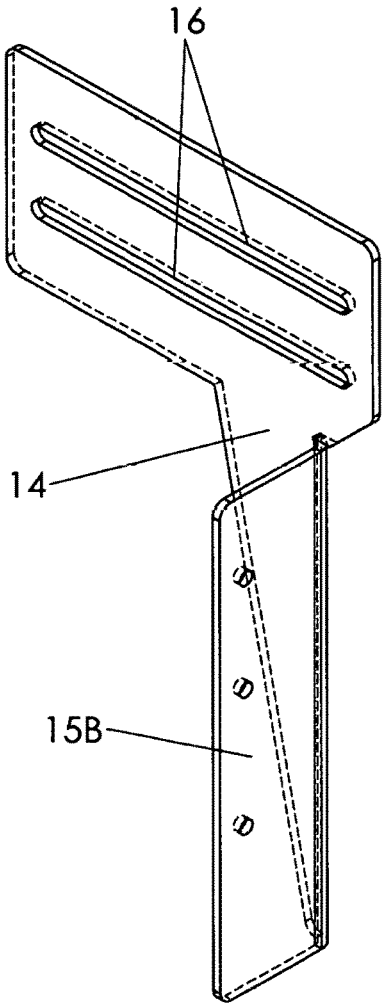

Each spacer is made up of two half spacers and their fasteners FIGS. 3, 3A and 3B. The spacer, FIG. 3, is designed to hold the formboards firmly against the bracket. It is placed in the pour area to maintain the desired width of pour. When the pour is still slightly fluid, but firm enough to hold the formboards in place, it is removed. The spacer can also be used in the pour area between the formboard and existing pours FIG. 4. Since the width of the spacer is adjustable by overlapping and interlocking spacer halves at the desired width, different thickness formboards or irregular existing edges of a pour can be accommodated and compensated for.

The fasteners, which join the bracket halves together and the spacer halves together, can be of several forms: slots, slotted holes, or a combination thereof. Screws, bolts, nuts and wingnuts may be used. With certain manufacturing processes, snap-on or cast interlocks (not shown) are conceivable and feasible.

The corners and bends in brackets and spacers will, where practical, be softened by radii to facilitate ease and safety of handling thereof. In the brackets and spacers it is desired as an option, but not shown for clarity, to provide markings along the horizontal slots and slotted holes. This would simplify setting the widths desired for a specific pour.

Manufacturing:

Brackets and spacers will be manufactured of the thickness, and strength appropriate to their usage.

The prototype made and illustrated herein—see FIGS. 1, 1A, 1B, 2, 3, 3A, 3B and 4, was cut from sheet steel by water jet and shaped by machine shop bending and would be appropriate for many uses such as forming versions of items 1, 2, 3, 4, and 5 listed in the summary. Large quantities can be made as described above or by using laser and plasma cutters, stamping machines, molds and other means, including but not limited to, forging and casting.

Brackets and spacers for heavy duty applications will likely require the use of, but not be limited to, the more stringent processes listed above.

While the materials for the brackets and spacers will likely be metal, other materials such as, but not limited to, plastics and composits may be used.

Using the Kit: An Example

The kit consisting of approximately 5-6 brackets and 5-6 spacers can be used as follows: the line that either an outer or inner form board is to follow on the ground is determined by string lines, chalk lines, or other means. Brackets are offset from the line a distance equal to the form board thickness and then placed approximately 2-3 ft apart. Anchorage thereof is set or partially set for at least one side of the brackets. A form board is then placed along the line. Brackets are checked for accuracy of alignment, then attached to the form board. Then the anchorage of both sides of the bracket is done and the other form board is placed and fastened to the other side of the brackets.

At this stage reinforcing rods can be placed as needed and supported by wire suspension using the holes in the brackets. Final inspection is in order to see that all ground anchorage is firmly in place and the system for pouring is intact.

The spacers are preset in width to conform to the pour width which is determined by the bracket settings and the form board thickness. The spacers are then placed in the pour area. The distance between spacers is determined by the need to hold the form boards firmly in place.

At this point "off the shelf" pour material can be mixed and poured for small projects. While the material is still pliable, the spacers are removed, the material "set", forms removed, and the process repeated as desired.

For small projects, especially pours where curves are involved, it may work better for the form board to be pre-attached to one side of the brackets, set on line and anchored.

Features:

1. Brackets and spacers, each can be fixed width or set by the user to different widths
2. Provides support for reinforcing rods by suspension with wires from bracket slots or holes.
3. Brackets and form boards can be partially pre-assembled. This could be especially useful on curved forms if form boards are attached to one side of brackets first, then set in place.
4. Brackets and spacers and their component pieces can be manufactured and sold off the shelf.
5. Kits can be assembled, packaged, and marketed. A kit would include enough brackets and spacers that, along with form boards, the user could form and pour an 8 ft to 10 ft section of pour at a time. The kit and form boards can then be removed, re-set, and the process repeated as desired.

Flexibility:

1. Variable width settings for the brackets and spacers.
2. A number of applications and usage.
3. Means of ground anchorage can be by steel rods, re-bar, spikes, metal or wood stakes.
4. Readily applicable to forming straight, multi-curved, and arc shaped pourings.
5. The tool and its components are re-usable.

Simplicity:

1. Ease of fabrication
2. Ease of handling and usage
3. Ease of dismantling and re-use
4. Ease of storage
5. Low tech Definitions 1. Component—Includes any part of the tool.
2. Bracket—The part of the tool used to confine the form boards.
3. Spacers—The part of the tool used to hold form boards apart or is used to space form boards away from an existing pour.
4. Pour, pouring, describes the material or its placement thereof within the formed areas. Pour may also be used in reference to an existing material.

REFERENCE NUMBERS 1-36 FOR FIGS. 1 THRU 8A

Figure 5:
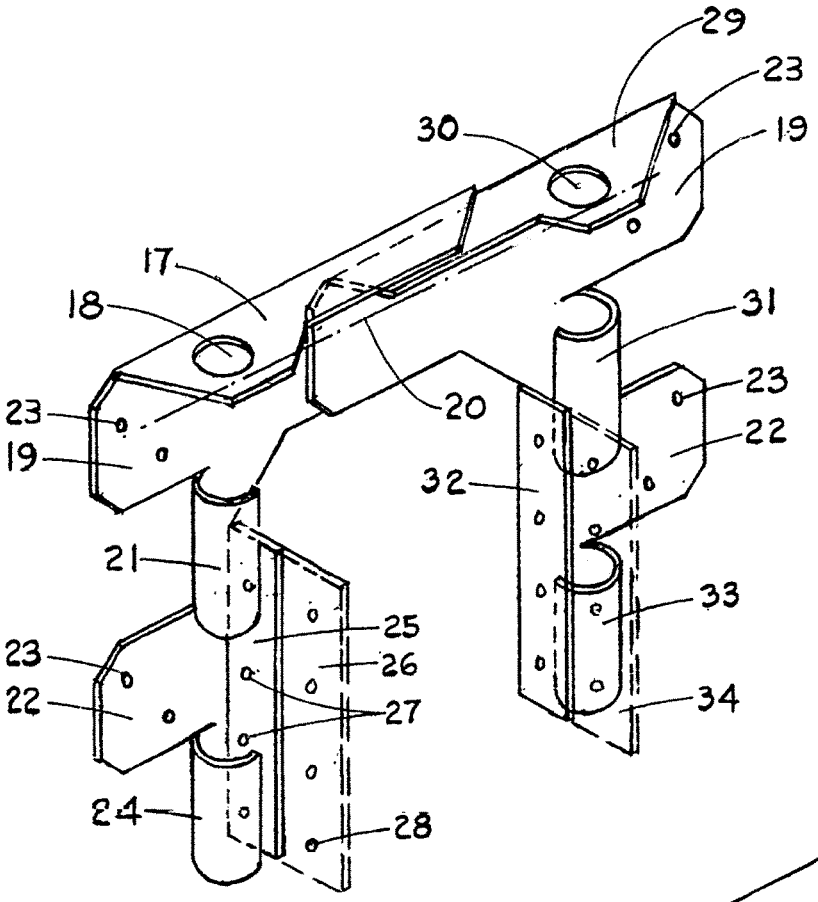
FIGS. 5, 5A, 5B and 6 embody optional designs for the brackets or components thereof.
Figure 6:
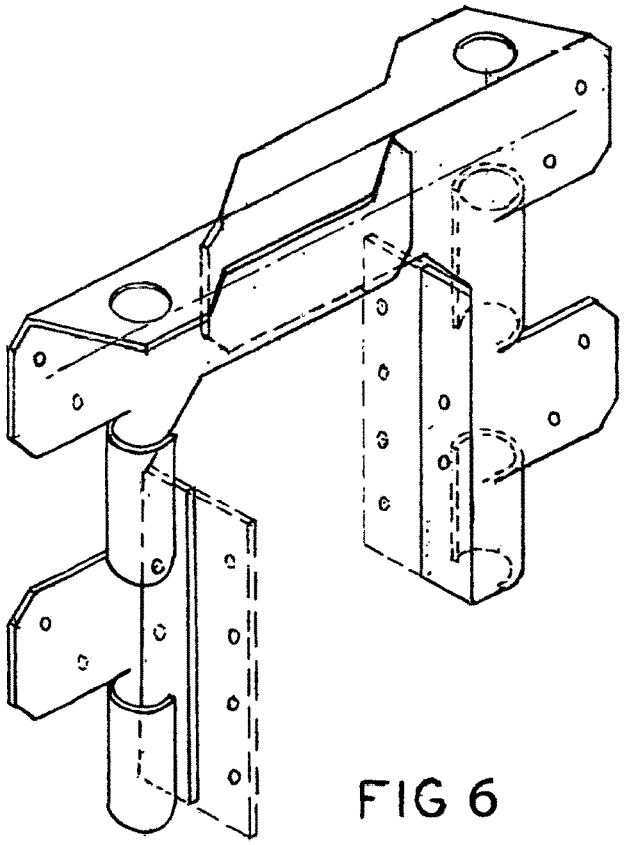
Figure 5A:
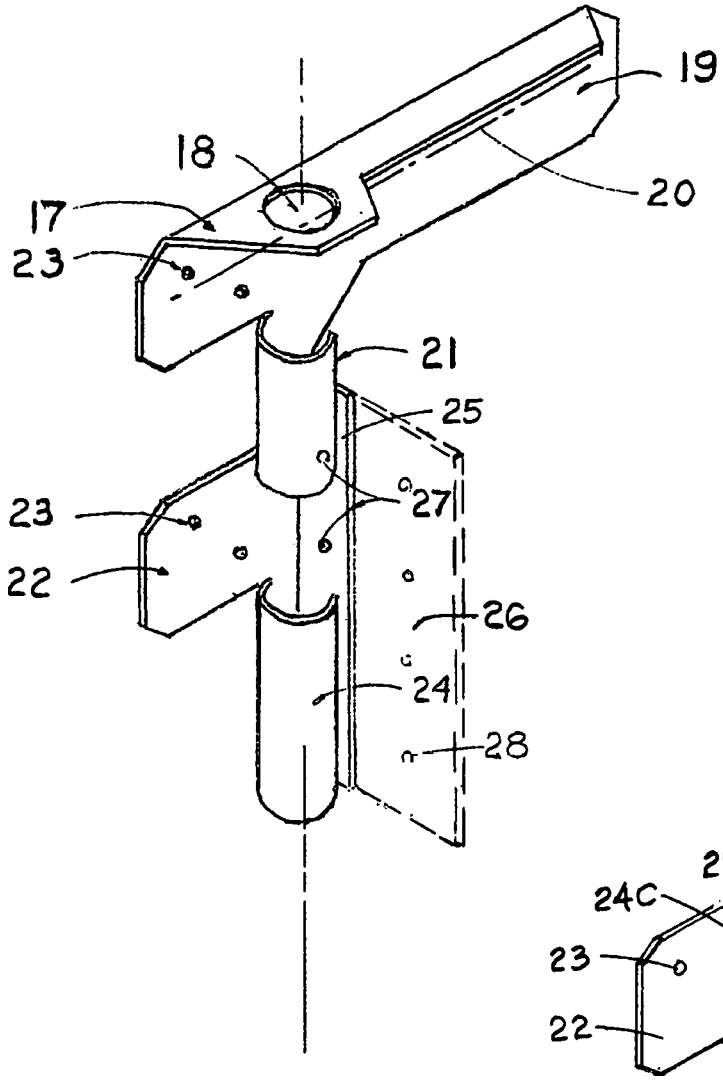
Figure 5B:
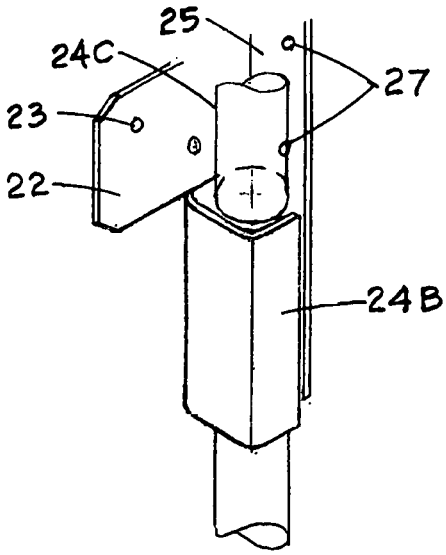

1. Top bend and housing for ground anchor guide hole 3
2. Main body of half bracket showing typical slotted holes for attaching to other half bracket, tie board, tie rod and others
2 B. Modified main body of half bracket, FIG. 7
3. Guide hole for ground anchor
4. Outer fin for stiffening, ground contact and stability, bent 90° to main body 2
4 B. Modified outer fin of half bracket, FIG. 7
5. Inner fin (shown partially dotted), bent 90° to main body 2
5 B. Modified inner fin of half bracket, FIG. 7
6. Housing for guide hole, bent 90° to main body 2
7. Guide hole for ground anchor aligns vertically with hole 3
8. Fastener holes for connecting wood ground anchor to main body 2
8 B. Holes in fin of half bracket for fastening formboards
8 C. Slotted holes in half bracket for fasteners
8 D. Linear horizontal slot in half bracket for fasteners
9. Reversed top bend and housing for ground anchor
10. Reversed outer fin
10 B. Modified outer fin of half bracket, reversed, FIG. 8
11. Reversed inner fin
11 B. Modified inner fin of half bracket, reversed, FIG. 8

12. Reversed housing with guide hole for metal ground anchor
12 B. Modified optional lower guide and housing for the metal anchor, FIG. 7
13. Modified optional reversed lower guide and housing for the metal anchor, FIG. 8
14. Main body of spacer half
15. Fin of the spacer half, bent 90 degrees to the main body 14
15 B. Reversed fin of the spacer half, bent 90 degrees to the main body 14
16. Linear horizontal slot for fastners
17. Top bend with guide hold for round ground anchor such as a metal stake, re-bar, spike
18. Guide hole for round metal anchors
19. Main body of bracket half
20. Row of slotted holes or horizontal slot for fasteners, details not shown
21. Rolled housing for ground anchor. Housing could be a pipe welded to main body 19 and fin 25
22. Fin for attaching wood stake anchor
23. Holes for nails, screws, to secure wood stake anchor. 2-3 holes per fin and the horizontal top part of bracket half
24. Rolled housing for ground anchor. See 21 for welded option
24B. Squared housing for ground anchor, in lieu of 24. For welded option, using squared housing in lieu of 24, see 21 for welded option, using squared housing in lieu of 21
24C. Ground anchor
25. Fin bent 90° from main body 19 and fin 22. Abuts and attaches to formboard
26. Fin extension with holes to attach to form board. Fin is optional
27. Holes in fin 25 for attaching the fin 25 to form board
28. Holes in fin 26 for attaching fin 26 to form board
29. Reversed top bend
30. Guide hole for round metal anchor
31. Reversed rolled housing for ground anchor
32. Reversed fin bent 90° from main body 19 and fin 22
33. Reversed rolled housing for ground anchor
34. Reversed fin extension
35. Formboard
36. Pour area

THE DRAWINGS

FIGS. 1 thru 7 and FIGS. 8 and 8A show the design of the tool and its different parts and features.

FIGS. 7 thru 7J show optional designs for the brackets and parts thereof.

Figure 1A:
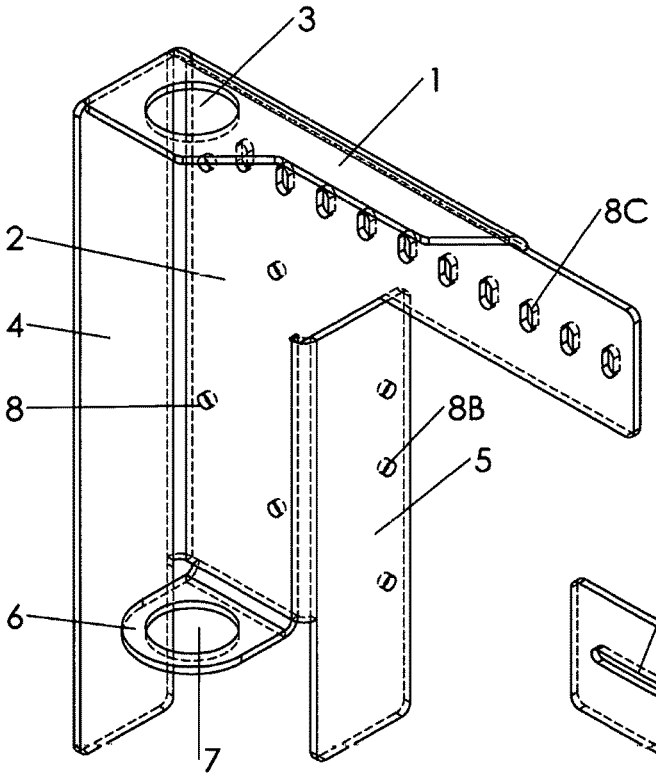
Figure 1B:
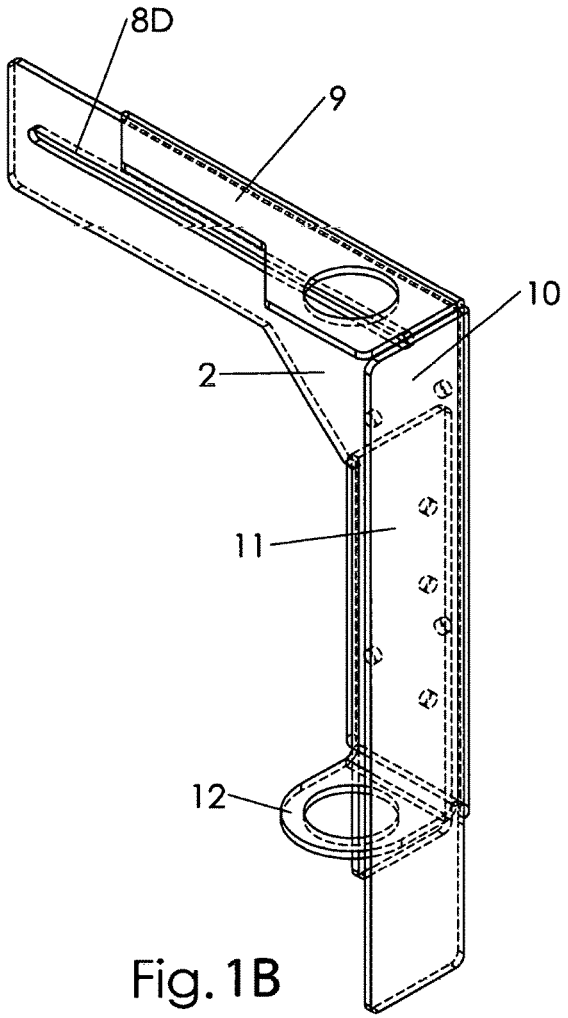
Figure 2:
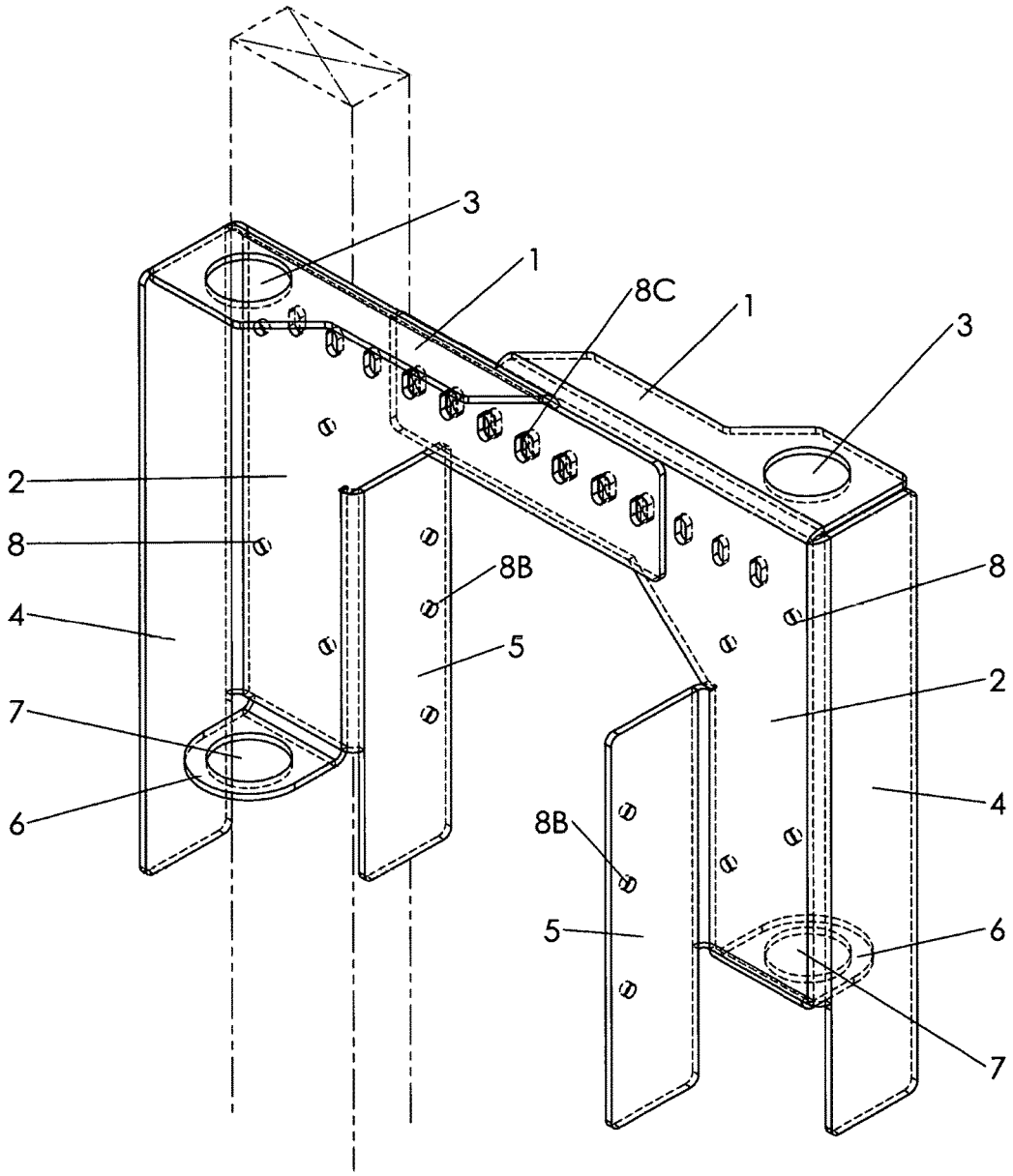

FIG. 1 shows half bracket FIG. 1A and half bracket FIG. 1B combined to form a bracket. Slotted holes 8 C are shown for fastening half brackets. Horizontal slots 8 D can be used in lieu of slotted holes 8 C.

FIG. 1A shows a half bracket. Slotted holes 8 C are shown for fastening half brackets. Horizontal slots 8 D can be used in lieu of slotted holes 8 C.

REFERENCE NUMBERS

1. Top bend and housing for ground anchor guide hole 3
2. Main body of half bracket showing typical slotted holes for attaching to other half brackets, tie boards, tie rods and others.
3. Guide hole for ground anchor.
4. Outter fin for stiffening, ground contact and stability, bent 90° to main body 2.
5. Inner fin (shown partially dotted), bent 90° to main body 2.
6. Housing for guide hole, bent 90° to main body 2.
7. Guide hole for ground anchor aligns with hole 3.
8. Fastener holes for main body 2 connected to wood ground anchor stakes in some cases, not shown for clarity.
8 B. Holes for fastening form boards to bracket fin 5.
8 C. Slotted holes for fastening half brackets, horizontal slots 8D can be used in lieu of slotted holes 8C.

FIG. 1B. shows a half bracket, same as in FIG. 1A except: Top bend and housing 9, outer fin 10, inner fin 11 and housing 12 for guide hole are all reversed. Horizontal slots 8 D are shown for fastening half brackets. Slotted holes 8 C can be used in lieu of horizontal slots 8 D.

FIG. 2 shows two FIG. 1A half brackets combined back to back to form a bracket. Slotted holes are shown for fastening the bracket halves horizontal slots can be used in lieu of slotted holes.

FIG. 3 shows a half spacers, FIGS. 3A and 3B assembled to form a spacer. See specification references numbers 14 thru 16, FIGS. 3, 3A and 3B. Spacer halves are fastened to each other by a miimum of two fasteners.

FIG. 3A shows a spacer half

REFERENCE NUMBERS

14. Main body of spacer half
15. Fin designed to abut form board or an existing pour. The fin is bent 90° from the main body 14.
16. Slots to fasten half spacers to each other by overlapping and sliding spacer halves, different widths and pour areas can be set, the half spacer slots aligned, and simple fasteners such as, but not united to, screws, nuts, and wing nuts can be used.

FIG. 3B shows a spacer half main body 14 and slots 16 are the same as in FIG. 3A fin 15B is bent in the opposite direction from the bend for fin 15. The fin is bent 90° from the main body 14. This means that when the two spacer halves are assembled and joined, see FIG. 3, the fins will be facing in the same direction. This is to stabilize the spacer and resist any rotational pressure from a liquefied pour.

FIG. 4 FIG. 4 Please note: It was determined in telecon with the USPTO office that it would be acceptable to submit this drawing with its written notes and arrows. Since the component pieces FIGS. 1A, 1B and 3 and their make-up are shown in detail elsewhere, this drawing is primarily showing the tools versatility. To replace it with referrence numbers would require 2 or more drawings. FIG. 4 shows half brackets FIG. 1A and FIG. 1B and spacers FIG. 3 used in tandem to form new sidewalks or new curbed edging to existing sidewalks. The half brackets are tied together with rigid ties such as boards and metal ties or other rigid ties, which are fastened to the half brackets. Spacers are used to determine and set the width of the curb areas.

FIGS. 5, 5A, 5B, and 6 embody optional designs for the brackets and parts thereof as described herein. See reference numbers 17 thru 34.

These embodiments were considered early in the tool design process. They were found to be logical, but not economically produced locally, they, along with the embodiments FIGS. 7 thru 8A above, are included herein because with manufacturing processes that are otherwise available they would be feasible for mass production.

FIGS. 7, 7A, 7B, 7C, 7D, 7E, 7F, 7G, 7H, 7I, 7J, 8 and 8A show different embodiments possible for the brackets shown in FIGS. 1 thru 2. Wherein the lower guide and housing for the metal anchors which are used to anchor the brackets to the ground is modified, and the main body 2B and fins 4B, 5B, 10B, 11B, and housings 12B and 13 are modified correspondingly and in accordance with the embodiment selected.

SEQUENCE LISTING

SPECIFICATION TILE SHEET
TITLE
INTRODUCTION
CROSS-REFERENCE TO RELATED APPLICATIONS
STATEMENT REGARDING FEDERALLY SPONSORED RESEARCH OR DEVELOPMENT
STATEMENT REGARDING PRIOR DISCLOSURES BY THE INVENTOR OR JOINT INVENTOR
BACKGROUND OF THE INVENTION
SUMMARY
BRIEF DESCRIPTION OF THE SEVERAL VIEWS OF THE DRAWING
DETAILED DESCTIPYION OF DRAWINGS AND SPECIFICATIONS
THE DRAWINGS
CLAIMS
ABSTRACT
SEQUENCE LISTING

The invention claimed is:

1. A curb/walk forming tool comprising:

two half brackets connected to form an inverted "U" shape when placed for forming in an upright position;

each half bracket comprising:

a main body, an outer fin extending perpendicularly from a side edge of the main body, an inner fin extending perpendicularly from an opposite edge of the main body and a top bend extending perpendicularly from an upper edge of the main body;

a top guide hole in the top bend of each half bracket;

a lower guide hole or formed surround extending perpendicularly from the lower edge of the main body that is vertically aligned with the top guide hole;

slots or slotted holes running lengthwise along the top bend of the main body of each half bracket, said slots or slotted holes accommodate fasteners for connecting the two half brackets;

holes in the main body of each half bracket for fastening wood or similar stakes for ground anchorage;

holes along each inner fin of each half bracket for fastening to form boards;

whereby the curb/walk forming tool can be adjusted to different widths and placements with variable widths achieved by overlapping the half components, moving them back and forth and fastening at the desired width.

* * * * *